US009482983B1

(12) United States Patent
Kono

(10) Patent No.: US 9,482,983 B1
(45) Date of Patent: Nov. 1, 2016

(54) IMAGE FORMING APPARATUS WITH MOVEABLE EXPOSURE DEVICE

(71) Applicant: FUJI XEROX CO., LTD., Tokyo (JP)

(72) Inventor: Hiroyuki Kono, Yokohama (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/945,858

(22) Filed: Nov. 19, 2015

(30) Foreign Application Priority Data

May 21, 2015 (JP) ..... 2015-103408

(51) Int. Cl.
*G03G 15/04* (2006.01)

(52) U.S. Cl.
CPC ..... *G03G 15/04* (2013.01)

(58) Field of Classification Search
CPC ..... G03G 15/04; G03G 21/1633; G03G 21/1666; G03G 2221/1636
See application file for complete search history.

(56) References Cited

U.S. PATENT DOCUMENTS 5,262,827 A * 11/1993 Lee ..... B41J 29/02 355/67
8,688,000 B2 4/2014 Sato et al.
2012/0207511 A1* 8/2012 Sato ..... G03G 21/1633 399/110
2013/0308983 A1* 11/2013 Takano ..... G03G 15/757 399/205
2014/0044450 A1* 2/2014 Nakamura ..... G03G 21/1623 399/110

FOREIGN PATENT DOCUMENTS

JP H08-318661 A 12/1996
JP 2003-112446 A 4/2003
JP 2012-145882 A 8/2012

* cited by examiner

*Primary Examiner* — Sandra Brase
(74) *Attorney, Agent, or Firm* — Oliff PLC

(57) ABSTRACT

An apparatus includes: an image holding element; an exposure device that exposes the image holding element to light; a holding member that holds the exposure device such that the exposure device is movable relative to an apparatus body between an exposure position, at which the exposure device exposes the image holding element to light, and a retracted position, at which the exposure device is located away from the image holding element; an open/close member that has a rotary shaft rotatably supported by the apparatus body and that opens and closes the apparatus body; a moving member that moves the exposure device between the exposure position and the retracted position via the holding member along with opening/closing movement of the open/close member; and a guide member formed with a guide surface that guides movement of the holding member and a holding portion that holds the holding member at the exposure position.

7 Claims, 9 Drawing Sheets

IMAGE FORMING APPARATUS WITH MOVEABLE EXPOSURE DEVICE

CROSS-REFERENCE TO RELATED APPLICATIONS

This application is based on and claims priority under 35 USC 119 from Japanese Patent Application No. 2015-103408 filed May 21, 2015.

BACKGROUND

Technical Field

The present invention relates to an image forming apparatus.

SUMMARY

According to an aspect of the present invention, there is provided an image forming apparatus including: an image holding element; an exposure device that exposes the image holding element to light; a holding member that holds the exposure device such that the exposure device is movable with respect to an apparatus body between an exposure position, at which the exposure device exposes the image holding element to light, and a retracted position, at which the exposure device is located away from the image holding element; an open/close member that has a rotary shaft 91 rotatably supported by the apparatus body and that opens and closes an opening portion of the apparatus body; a moving member that moves the exposure device between the exposure position and the retracted position via the holding member along with opening/closing movement of the open/close member; and a guide member formed with a guide surface that guides movement of the holding member and a holding portion that holds the holding member at the exposure position.

BRIEF DESCRIPTION OF THE DRAWINGS

An exemplary embodiment of the present invention will be described in detail based on the following figures, wherein.

DETAILED DESCRIPTION

Figure 1:
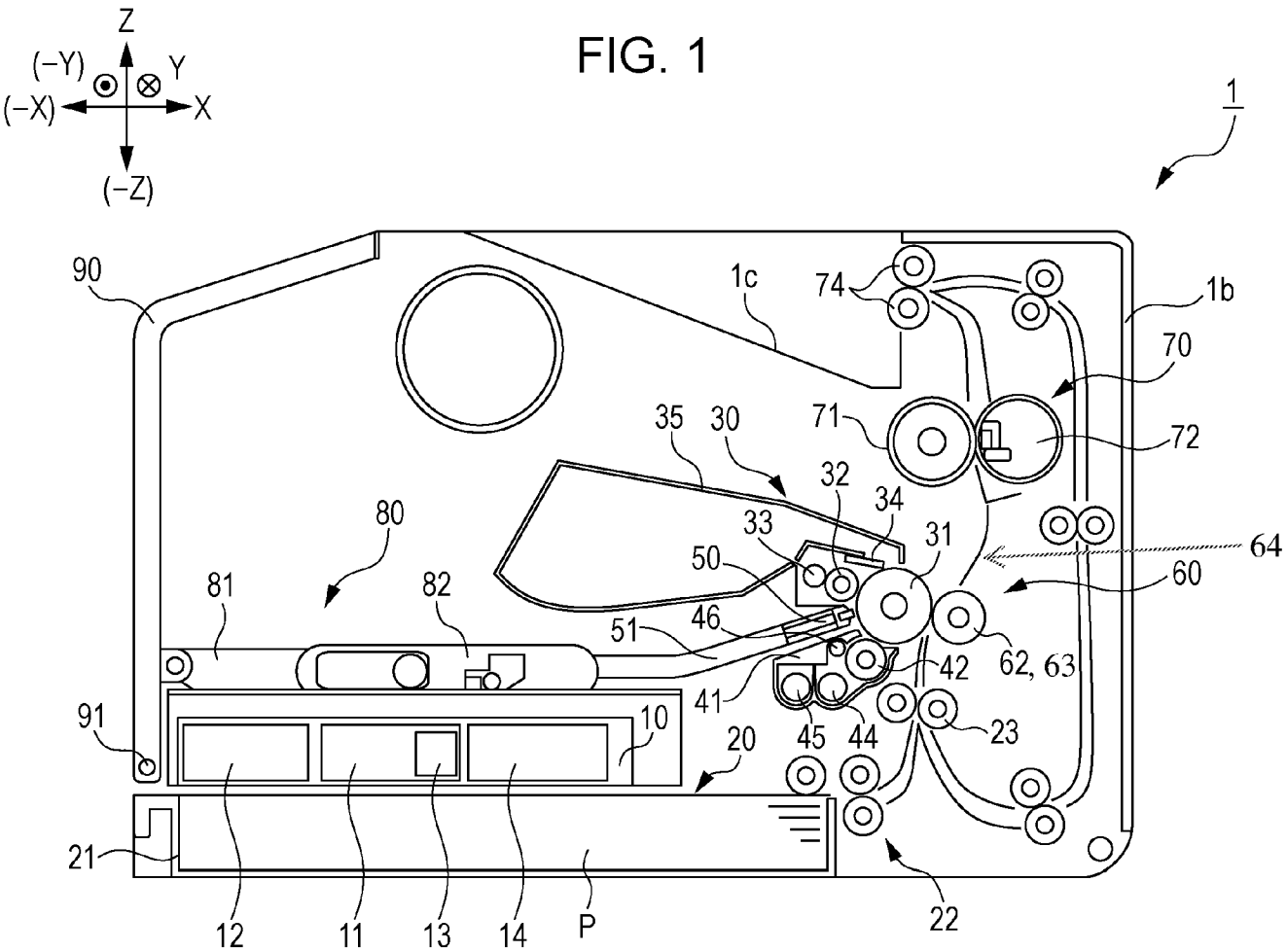
FIG. 1 is a schematic vertical sectional view illustrating the internal configuration of an image forming apparatus 1.

An exemplary embodiment and a specific example of the present invention will be described in detail below with reference to the drawings. The present invention is not limited to the following exemplary embodiment and specific example.

It should be noted that, in the following description of the drawings, the drawings are schematic and the ratio of dimensions etc. may be different from the actual value, and that members other than those required to describe the present invention may not be illustrated as appropriate for ease of understanding.

In the drawings, in order to facilitate understanding of the following description, the front-rear direction is defined as the X-axis direction, the left-right direction is defined as the Y-axis direction, and the up-down direction is defined as the Z-axis direction.

(1) Overall Configuration and Operation of Image Forming Apparatus

FIG. 1 is a schematic vertical sectional view illustrating the internal configuration of an image forming apparatus 1 according to an exemplary embodiment.

The overall configuration and operation of the image forming apparatus 1 will be described below with reference to the drawing.

The image forming apparatus 1 includes a control device 10, a paper transport device 20, a photosensitive unit 30, a developing device 40, an exposure device 50, a transfer device 60, a fixing device 70, and a retraction mechanism 80.

An open/close covering 90, which serves as an example of an open/close member, is rotatably supported on the front surface of the image forming apparatus 1. The open/close covering 90 is opened forward (−X direction) to expose the inside of the image forming apparatus 1 for replacement of consumables etc.

A rear cover 1*b* is rotatably supported on the rear surface of the image forming apparatus 1. The rear cover 1*b* is opened to expose the inside of the image forming apparatus 1 for an internal check for a paper jam etc.

An upper cover 1*c*, which also serves as an ejection tray for ejection and storage of paper on which an image has been recorded, is formed on the upper surface (Z direction) of the image forming apparatus 1.

The control device 10 includes an image forming apparatus control section 11, a controller section 12, an exposure control section 13, a power source device 14, and so forth. The image forming apparatus control section 11 controls operation of the image forming apparatus 1. The controller section 12 prepares image data according to a printing process request. The exposure control section 13 controls lighting of a light source of the exposure device 50. The power source device 14 applies a voltage to a charging roller 32, a developing roller 42, a power feed roller 63, and so forth to be discussed later, and supplies power to the exposure device 50.

The controller section 12 converts image data input from an image reading device (not illustrated) and printing information input from an external information transmission device (such as a personal computer, for example) into image information for latent image formation, and outputs a drive signal to the exposure control section 13 at a timing set in advance.

The paper transport device 20 is provided at the bottom portion of the image forming apparatus 1. The paper transport device 20 includes a paper cassette 21. A large number of sheets of paper P, which serve as a storage medium, are loaded on the upper surface of the paper cassette 21. The paper P, the position of which in the width direction is determined by restriction plates (not illustrated), is drawn rearward (X direction) from above, one sheet at a time, by a paper drawing portion 22, and thereafter transported to a contact portion of a resist roller pair 23.

The photosensitive unit 30 is provided above the paper transport device 20, and includes a photosensitive drum 31 provided in a unit housing 35 and rotationally driven. The charging roller 32, the developing device 40, a transfer roller 62, and a cleaning blade 34 are disposed along the rotational direction of the photosensitive drum 31. A cleaning roller 33 is disposed to face and contact the charging roller 32 to clean the surface of the charging roller 32.

The developing device 40 includes a developing housing 41 that stores a developer inside. The developing roller 42 and a pair of augers 44 and 45 are disposed in the developing housing 41. The developing roller 42 is disposed to face the photosensitive drum 31. The augers 44 and 45 are provided obliquely below and on the back side of the developing roller 42 to agitate and transport the developer toward the developing roller 42. A layer restriction roller 46 is disposed in proximity to the developing roller 42 to restrict the layer thickness of the developer.

The exposure device 50 is constituted of a light emitting diode (LED) head in which plural LEDs are linearly arranged along the principal scanning direction, and exposes the surface of the photosensitive drum 31 to light modulated in accordance with data on an image to be formed.

The exposure device 50 is movable with respect to an apparatus body between an exposure position, at which the exposure device 50 exposes the photosensitive drum 31 to light, and a retracted position, at which the exposure device 50 is located away from the photosensitive drum 31, via the retraction mechanism 80 with the exposure device 50 held by a holding member 51 in accordance with opening/closing operation of the open/close covering 90.

The surface of the photosensitive drum 31 which is rotatable is charged by the charging roller 32. An electrostatic latent image is formed on the surface of the photosensitive drum 31 by the exposure device 50. The electrostatic latent image formed on the photosensitive drum 31 is developed as a toner image by the developing roller 42.

The transfer device 60 is composed of the rear cover 1*b* and the transfer roller 62. The rear cover 1*b* supports the transfer roller 62 so that the transfer roller 62 comes into and out of contact with the photosensitive drum 31. The transfer roller 62 forms a nip together with the photosensitive drum 31. A transfer voltage is applied to the transfer roller 62 from the power source device 14 which is controlled by the image forming apparatus control section 11. The toner image on the photosensitive drum 31 is transferred to the paper P which passes between the photosensitive drum 31 and the transfer roller 62.

Residual toner remaining on the surface of the photosensitive drum 31 is removed by the cleaning blade 34, and recovered into the unit housing 35 which supports the photosensitive drum 31. After that, the surface of the photosensitive drum 31 is recharged by the charging roller 32. The residue that is not removed by the cleaning blade 34 but attached to the charging roller 32 is captured by the surface of the cleaning roller 33 which rotates in contact with the charging roller 32, and temporarily stored thereon.

The fixing device 70 includes a pair of a heating module 71 and a pressurizing module 72. A press contact region between the heating module 71 and the pressurizing module 72 forms a fixing nip portion (fixing region).

The paper P to which the toner image has been transferred by the transfer roller 62 is transported to the fixing device 70 by way of a transport guide 64 with the toner image unfixed. When the paper P is transported to the fixing device 70, the toner image is fixed by the pair of the heating module 71 and the pressurizing module 72 by the action of pressure bonding and heating. When the toner image is fixed, the paper P is ejected by an ejection roller pair 74 to the upper cover 1*c* on the upper surface of the image forming apparatus 1.

(2) Retraction Mechanism

Figure 2:
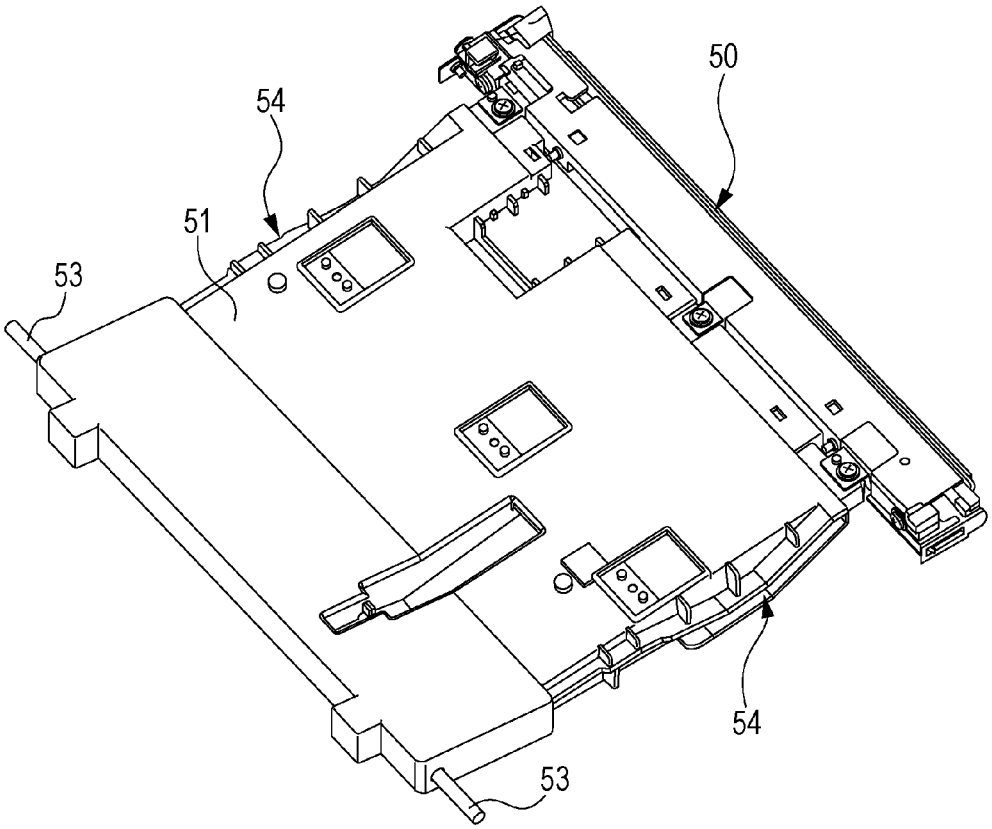
FIG. 2 is a perspective view illustrating the overall configuration of a holding member 51 holding an exposure device 50.
Figure 3:
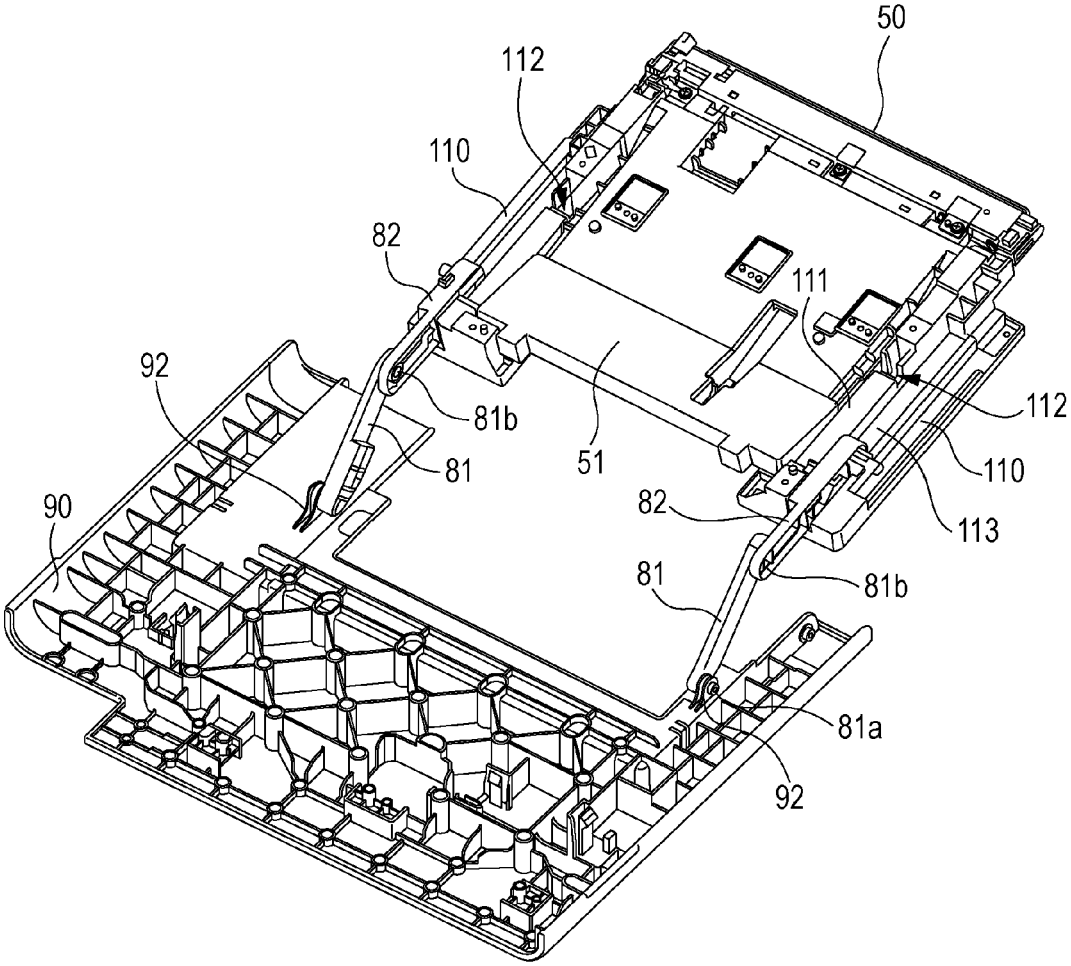
FIG. 3 is a perspective view illustrating the positional relationship between the holding member 51 holding the exposure device 50 and an open/close covering 90, the holding member 51 and the open/close covering 90 being coupled to each other by a retraction mechanism 80.
Figure 4:
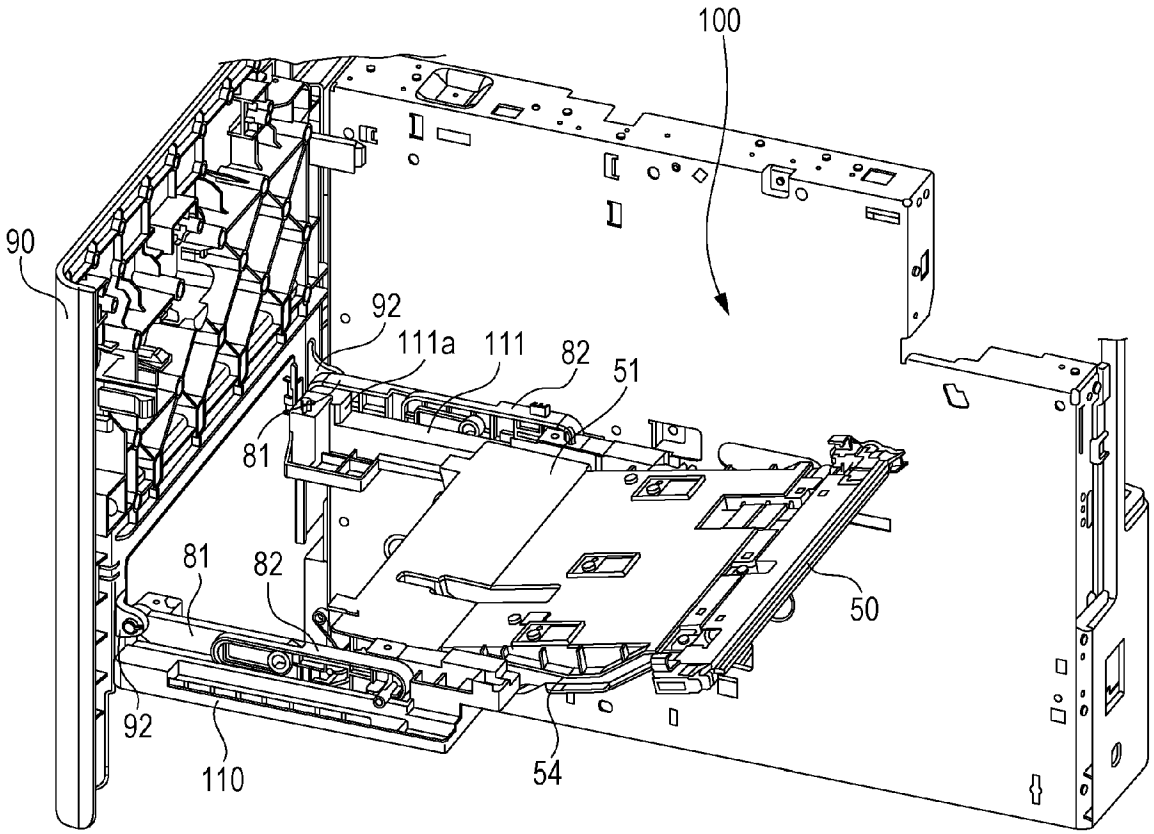
FIG. 4 is a perspective view illustrating the positional relationship among the holding member 51 holding the exposure device 50, the retraction mechanism 80, and the open/close covering 90, the components being attached to an apparatus body.
Figure 5:
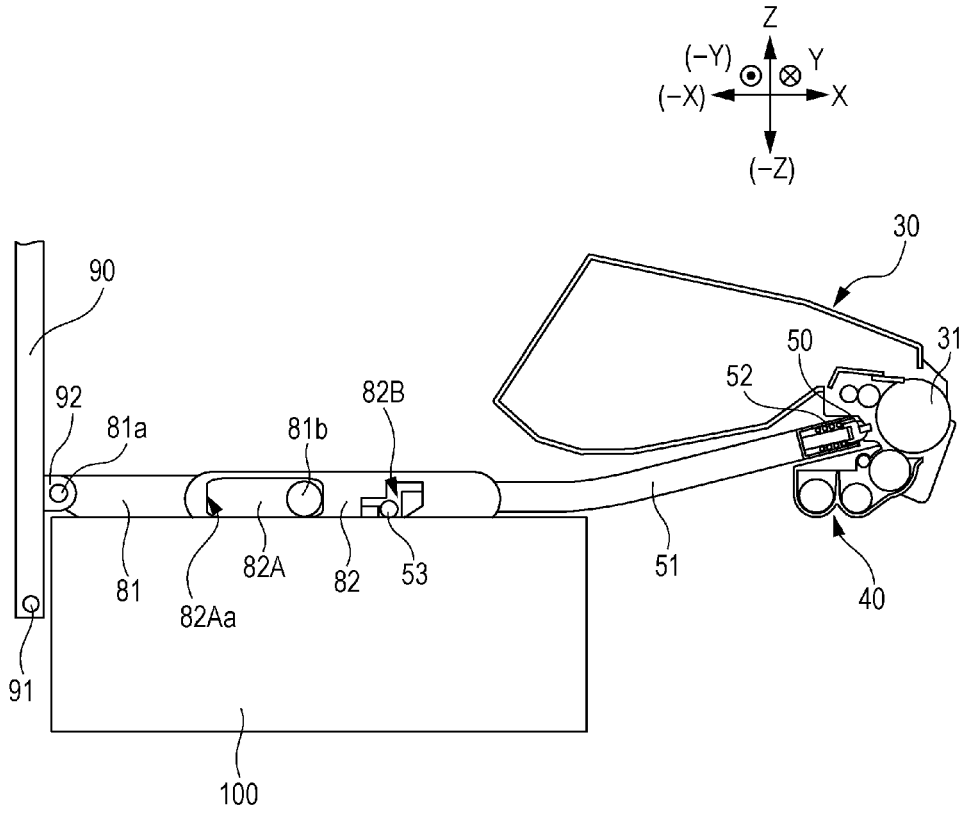
FIG. 5 is a schematic sectional view illustrating the positional relationship among the exposure device 50 at an exposure position, a photosensitive unit 30, a developing device 40, the retraction mechanism 80, and the open/close covering 90.
Figure 6:
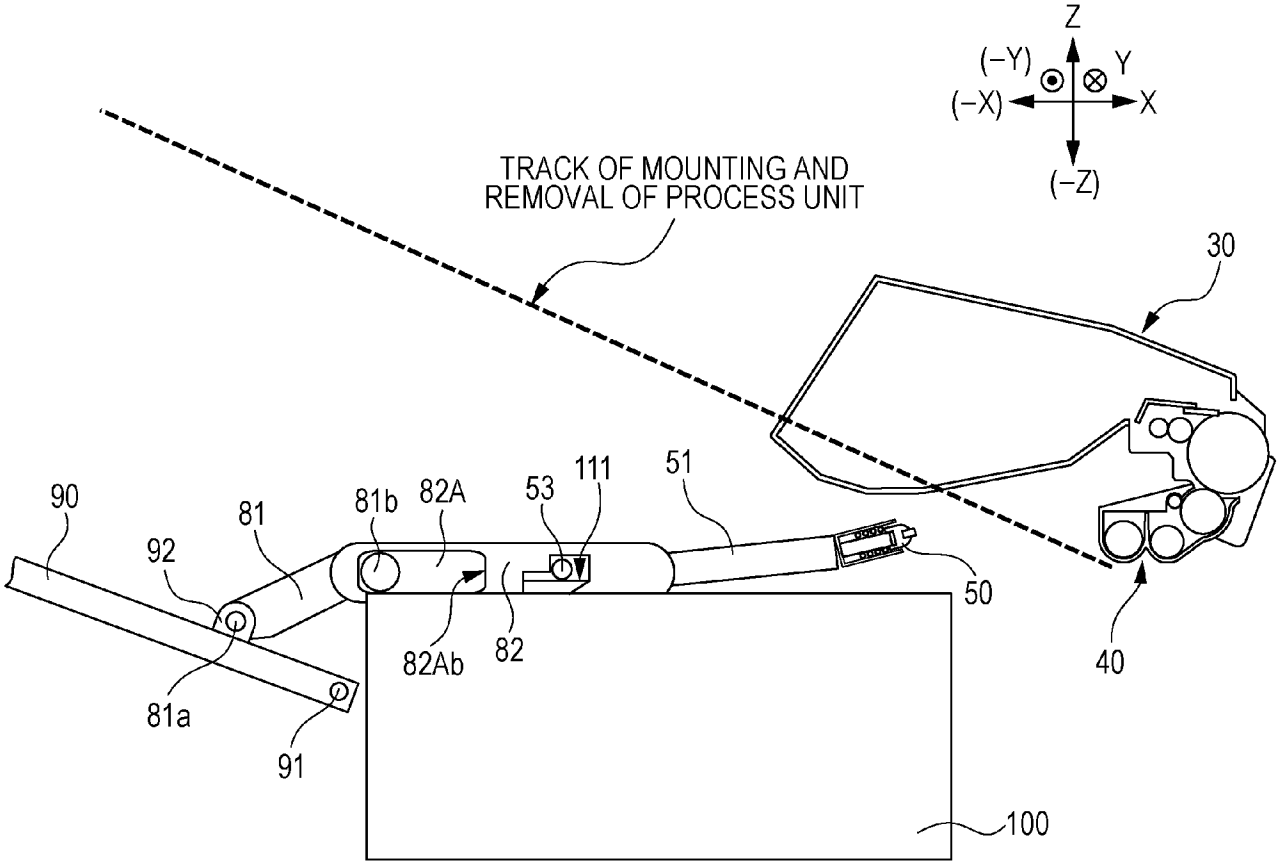
FIG. 6 is a schematic sectional view illustrating the positional relationship among the exposure device 50 at a retracted position, the photosensitive unit 30, the developing device 40, the retraction mechanism 80, and the open/close covering 90.

FIG. 2 is a perspective view illustrating the overall configuration of the holding member 51 holding the exposure device 50. FIG. 3 is a perspective view illustrating the positional relationship between the holding member 51 holding the exposure device 50 and the open/close covering 90, the holding member 51 and the open/close covering 90 being coupled to each other by the retraction mechanism 80. FIG. 4 is a perspective view illustrating the positional relationship among the holding member 51 holding the exposure device 50, the retraction mechanism 80, and the open/close covering 90, the components being attached to the apparatus body. FIG. 5 is a schematic sectional view illustrating the positional relationship among the exposure device 50 at the exposure position, the photosensitive unit 30, the developing device 40, the retraction mechanism 80, and the open/close covering 90. FIG. 6 is a schematic sectional view illustrating the positional relationship among the exposure device 50 at the retracted position, the photosensitive unit 30, the developing device 40, the retraction mechanism 80, and the open/close covering 90.

Retracting operation of the exposure device 50 and an operation for mounting and removing the photosensitive unit 30 and the developing device 40 to and from the apparatus body will be described below with reference to the drawings.

The exposure device 50 is held by the holding member 51, and movable with respect to the apparatus body between the exposure position, at which the exposure device 50 exposes the photosensitive drum 31 to light, and the retracted position, at which the exposure device 50 is located away from the photosensitive drum 31, in accordance with opening/closing operation of the open/close covering 90.

At the exposure position (see FIG. 5), the exposure device 50 is positioned between the photosensitive unit 30 and the developing device 40 with a predetermined gap from the photosensitive drum 31. At the retracted position (see FIG. 6), the exposure device 50 is held away from the photosensitive drum 31 so as not to interfere with the track of movement (indicated by the broken line in FIG. 6) of an operation for mounting and removing the photosensitive unit 30 and the developing device 40.

(2.1) Holding Member

The holding member 51 supports the exposure device 50, and includes a compression coil spring 52 (see FIG. 5). The compression coil spring 52 is provided at the distal end portion of the holding member 51, and serves as a pressing member that presses the exposure device 50 toward the photosensitive drum 31 at the exposure position. At the exposure position, the holding member 51 positions the exposure device 50 with a predetermined gap from the photosensitive drum 31.

A guide shaft 53 is provided at the other end of the holding member 51. The guide shaft 53 penetrates a body of the holding member 51 in a direction that intersects the direction of movement of the holding member 51, and projects to both sides from the holding member 51. The holding member 51 is movable between the exposure position and the retracted position (in the X direction) with the guide shaft 53 coupled to the retraction mechanism 80 to be discussed later and guided by a guide member 110 along with movement of the retraction mechanism 80.

A guide 54 that follows the track of movement of the holding member 51 is formed on both side surfaces of the holding member 51 that intersect the direction of movement of the holding member 51. The guide 54 guides the exposure device 50 held by the holding member 51 such that the exposure device 50 moves in the gap between the photosensitive unit 30 and the developing device 40.

(2.2) Retraction Mechanism

The retraction mechanism 80 is composed of a first link member 81, a second link member 82, and the guide member 110. The first link member 81, which is a component of a moving member, has a shaft portion 81*a* at one end rotatably supported by the open/close covering 90. The second link member 82, which is the other component of the moving member, has one end movably coupled to a shaft portion 81*b* at the other end of the first link member 81 to move the holding member 51. The guide member 110 guides movement of the holding member 51, and holds the holding member 51 at the exposure position.

(2.2.1) First Link Member

The first link member 81 includes the shaft portions 81*a* and 81*b* which project from both ends of an arm portion that extends in one direction. The shaft portion 81*a* at one end is rotatably supported by a coupling portion 92 on the inner surface side of the open/close covering 90. The shaft portion 81*b* at the other end is movably coupled to a groove portion 82A of the second link member 82.

(2.2.2) Second Link Member

The second link member 82 includes the groove portion 82A and an abutment portion 82B. The groove portion 82A is formed in a long hole shape at one end of the arm portion which extends in one direction, and penetrates the second link member 82 in the thickness direction. The abutment portion 82B is formed in a key shape at a middle portion of the arm portion, and penetrates the second link member 82B in the thickness direction.

The shaft portion 81*b* of the first link member 81 is coupled to the groove portion 82A. The second link member 82 allows movement of the shaft portion 81*b* of the first link member 81 not to be moved when the shaft portion 81*b* is in the range of the long hole of the groove portion 82A. The second link member 82 is moved along with rotational movement of the open/close covering 90 when the shaft portion 81*b* of the first link member 81 contacts an end 82Aa or an end 82Ab of the groove portion 82A.

The abutment portion 82B is composed of a first abutment portion 82Ba and a second abutment portion 82Bb. The first abutment portion 82Ba abuts against the guide shaft 53 of the holding member 51 to press the holding member 51 in a first movement direction, in which the holding member 51 is moved from the retracted position toward the exposure position, when the open/close covering 90 is closed. The second abutment portion 82Bb abuts against the guide shaft 53 to press the holding member 51 in a direction opposite to the first movement direction when the open/close covering 90 is opened.

The second abutment portion 82Bb includes an inclined portion 82Bc formed to be inclined with respect to the first movement direction. When the second link member 82 is moved in the direction opposite to the first movement direction, the inclined portion 82Bc contacts the guide shaft 53 to push up the guide shaft 53 away from a holding portion 112 of the guide member 110.

(2.2.3) Guide Member

The guide member 110 includes a guide surface 111, a wall portion 111*a*, the holding portion 112 which is recessed, and a guide surface 113. The guide surface 111 is fixed to a housing 100, and guides movement of the guide shaft 53 of the holding member 51. The wall portion 111*a* is formed at one end of the guide surface 111, and abuts against the guide shaft 53 at the retracted position. The holding portion 112 is formed at the other end of the guide surface 111, and holds the guide shaft 53 of the holding member 51 at the exposure position. The guide surface 113 guides movement of the second link member 82.

When the open/close covering 90 is closed, the guide shaft 53 of the holding member 51 is pressed by the first abutment portion 82Ba of the second link member 82 to be moved while sliding along the guide surface 111, and moved away from the second link member 82 at a terminal end 111*b* of the guide surface 111 to be fitted in the recessed holding portion 112.

(2.2.4) Urging Member

An urging member 83 is a torsion spring formed from a metal wire, and includes a wound portion 83A, a fixed portion 83B, and an arm portion 83C. The wound portion 83A is formed by winding the wire into a circular shape plural times. The arm portion 83C has a free end.

When the holding member 51 is moved to the exposure position with the fixed portion 83B fixed to the housing 100, the urging member 83 urges the guide shaft 53 of the holding member 51 to move the guide shaft 53 away from the first abutment portion 82Ba of the second link member 82 toward the holding portion 112 of the guide member 110 with the free end of the arm portion 83C contacting the guide shaft 53.

(3) Operation for Mounting and Removal of Photosensitive Unit

Figure 7A:
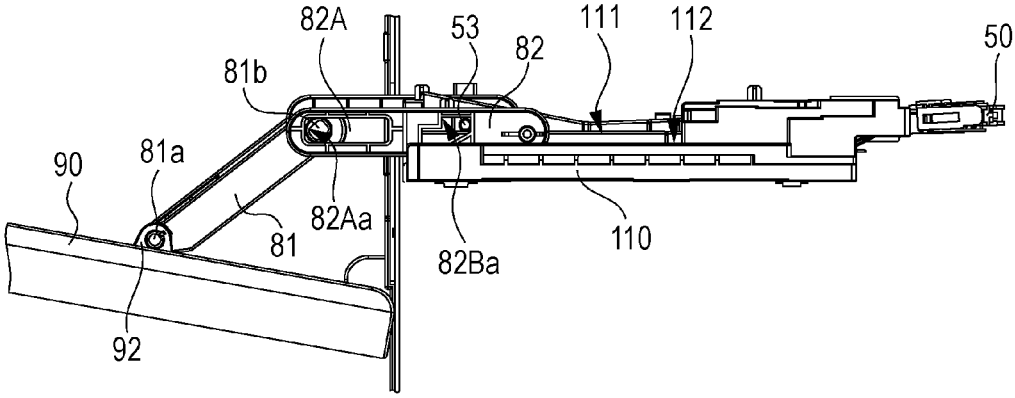
FIG. 7A is a schematic sectional view illustrating the position of the retraction mechanism 80 with the open/close covering 90 opened.
Figure 7B:
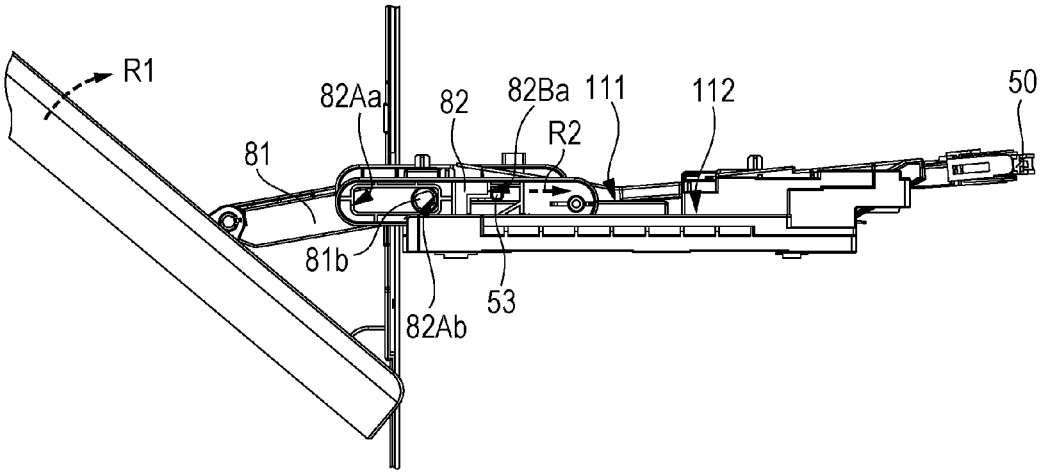
FIG. 7B is a schematic sectional view illustrating the position of the retraction mechanism 80 at the start of an operation for closing the open/close covering 90.

FIG. 7A is a schematic sectional view illustrating the position of the retraction mechanism 80 with the open/close covering 90 opened. FIG. 7B is a schematic sectional view illustrating the position of the retraction mechanism 80 at the start of an operation for closing the open/close covering 90.

Figure 8A:
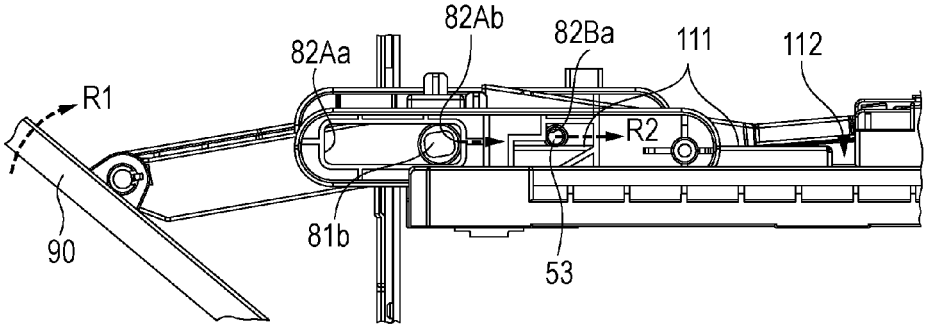
FIG. 8A is a schematic sectional view illustrating a state in which the holding member 51 is in the middle of being moved to the exposure position as guided by a guide member 110.
Figure 8B:
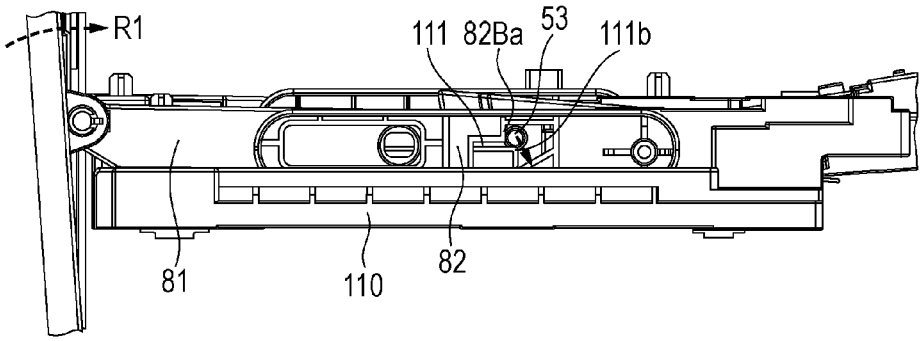
FIG. 8B is a schematic sectional view illustrating a state immediately before the holding member 51 which has been moved to the exposure position as guided by the guide member 110 is held by a holding portion 112.
Figure 8C:
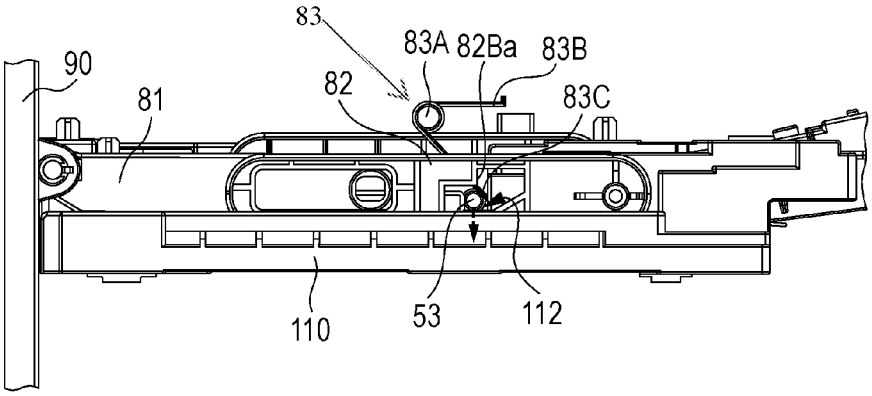
FIG. 8C is a schematic sectional view illustrating a state in which the holding member 51 is held by the holding portion 112 of the guide member 110.
Figure 9:
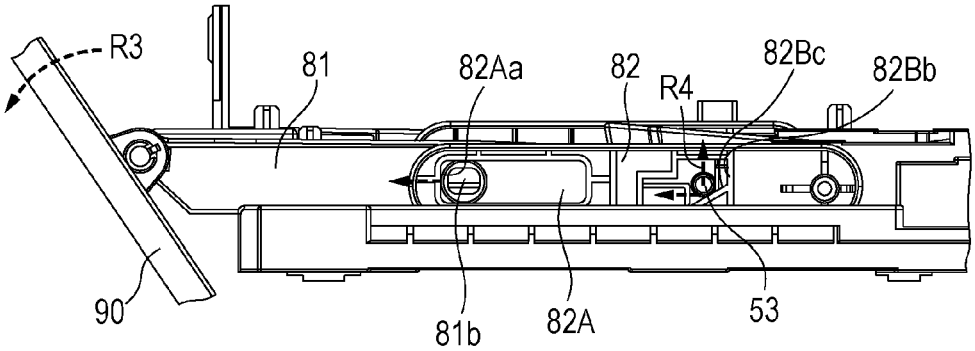
FIG. 9 is a schematic sectional view illustrating the position of the retraction mechanism 80 at the start of an operation for opening the open/close covering 90.

FIG. 8A is a schematic sectional view illustrating a state in which the holding member 51 is in the middle of being moved to the exposure position as guided by the guide member 110. FIG. 8B is a schematic sectional view illustrating a state immediately before the holding member 51 which has been moved to the exposure position as guided by the guide member 110 is held by the holding portion 112. FIG. 8C is a schematic sectional view illustrating a state in which the holding member 51 is held by the holding portion 112 of the guide member 110. FIG. 9 is a schematic sectional view illustrating the position of the retraction mechanism 80 at the start of an operation for opening the open/close covering 90.

Retracting operation of the exposure device 50 will be described below with reference to the drawings.

(3.1) Mounting of Photosensitive Unit

An operation is performed to mount and remove the photosensitive unit 30 and the developing device 40 through an opening portion of the apparatus body along a guide rail (not illustrated) with the exposure device 50 moved away from the photosensitive unit 30 to the retracted position at which the exposure device 50 does not interfere with the track of movement of the operation for mounting and removing the photosensitive unit 30 and the developing device 40 (see FIG. 6).

When the open/close covering 90 is rotationally operated to open the opening portion of the apparatus body as illustrated in FIG. 7A, the second link member 82 is positioned at the retracted position at which the exposure device 50 does not interfere with the track of movement of an operation for mounting and removing the photosensitive unit 30 with the shaft portion 81*b* of the first link member 81, which is coupled to the open/close covering 90, contacting the one end 82Aa of the groove portion 82A. In this state, an operation is performed to mount the photosensitive unit 30 and the developing device 40 along the guide rail (not illustrated).

When the open/close covering 90 is rotationally operated (see the arrow R1 in FIG. 7B) so as to close the opening portion of the apparatus body as illustrated in FIG. 7B, the first link member 81 is moved in the groove portion 82A of the second link member 82 until the first link member 81 contacts the other end 82Ab.

The second link member 82 starts moving in the horizontal direction (X direction; see the arrow R2 in FIG. 7B) as guided by the guide surface 113 of the guide member 110 with the first abutment portion 82Ba pressing the guide shaft 53 of the holding member 51.

When the second link member 82 starts moving in the horizontal direction (X direction), the holding member 51 is moved in the horizontal direction (X direction) (see the arrow R2 in FIG. 8A) with the guide shaft 53 pressed by the first abutment portion 82Ba along the guide surface 111 of the guide member 110.

When the open/close covering 90 is further rotationally operated so as to close the opening portion of the apparatus body, the guide shaft 53 is moved in the horizontal direction (X direction) (see FIG. 8B) while being pressed by the first abutment portion 82Ba until the guide shaft 53 is positioned at the terminal end 111*b* of the guide surface 111 of the guide member 110.

When the open/close covering 90 is closed in this state, the guide shaft 53 receives the urging force of the urging member 83 to be fitted in the holding portion 112 of the guide member 110 so that the holding member 51 is held at the exposure position (see FIG. 8C).

The exposure device 50 which is held by the holding member 51 is positioned at the exposure position (see FIG. 5) in the state of being urged by the compression coil spring 52 (illustrated in FIG. 5) to be closer to the photosensitive drum 31.

At the exposure position, the holding member 51 holding the exposure device 50 is held by the holding portion 112 of the guide member 110, and the guide shaft 53 of the holding member 51 is not in contact with the first abutment portion 82Ba of the second link member 82.

As a result, the reaction force of the compression coil spring 52 which presses the exposure device 50 toward the photosensitive drum 31 is received by the holding portion 112 of the guide member 110, and not received by the inner surface of the open/close covering 90 which is coupled to the second link member 82 via the first link member 81.

At the exposure position, the first link member 81 of the retraction mechanism 80, which couples the open/close covering 90 and the holding member 51 of the exposure device 50 to each other, is movable in the range of the long hole of the groove portion 82A of the second link member 82, even in the case where the open/close covering 90 is slightly opened because of backlash in engagement with the apparatus body, for example, which does not affect the holding member 51 which is held by the holding portion 112 of the guide member 110.

(3.1) Removal and Mounting of Process Unit

When opening operation (see the arrow R3 in FIG. 9) of the open/close covering 90 is started, the first link member 81 is moved in the range of the long hole of the groove portion 82A of the second link member 82 along with rotational movement of the open/close covering 90. When the first link member 81 contacts the one end 82Ab, the second link member 82 starts moving from the exposure position toward the retracted position.

When the second link member 82 starts moving, the guide shaft 53 is pushed upward (Z direction; see the arrow R4 in FIG. 9) from the holding portion 112 of the guide member 110 with the inclined portion 82Bc formed on the second abutment portion 82Bb contacting the guide shaft 53 as illustrated in FIG. 9 to move the guide shaft 53 away from the holding portion 112.

When the open/close covering 90 is further rotated, the guide shaft 53 abuts against the wall portion 111*a* (see FIG. 4) formed at one end of the guide surface 111 of the guide member 110 so that further horizontal movement of the guide shaft 53 is restricted, and the exposure device 50 is positioned at the retracted position at which the exposure device 50 does not interfere with the track of movement of an operation for mounting and removing the photosensitive unit 30 and the developing device 40.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image holding element;

an exposure device that exposes the image holding element to light;

a holding member that holds the exposure device such that the exposure device is movable with respect to an apparatus body between an exposure position, at which the exposure device exposes the image holding element to light, and a retracted position, at which the exposure device is located away from the image holding element;

an open/close member that has a rotary shaft rotatably supported by the apparatus body and that opens and closes an opening portion of the apparatus body;

a moving member that moves the exposure device between the exposure position and the retracted position via the holding member along with opening/closing movement of the open/close member; and a guide member formed with a guide surface that guides movement of the holding member and a holding portion that holds the holding member at the exposure position, wherein the moving member comprises:

a first link member having a first end and a second end, the first end being rotatably supported by the open/close member, and a second link member with one end movably coupled to the second end of the first link member, the second link member being formed with an abutment portion that contacts a guided shaft to move the holding member, the guided shaft being provided to project from the holding member and movable as guided by the guide member, and the abutment portion and the guided shaft are not in contact with each other when the open/close member is closed.

2. The image forming apparatus according to claim 1, wherein the abutment portion comprises:

a first abutment portion that abuts, when the open/close member is being closed, against the guided shaft to press the holding member in a first movement direction in which the holding member is moved from the retracted position toward the exposure position, and a second abutment portion that abuts, when the open/close member is being opened, against the guided shaft to press the holding member in a direction opposite to the first movement direction.

3. The image forming apparatus according to claim 2, wherein the second abutment portion comprises an inclined portion formed to be inclined with respect to the first movement direction, the inclined portion contacting the guided shaft to move the guided shaft from the holding portion of the guide member when the second link member is moved in the direction opposite to the first movement direction.

4. The image forming apparatus according to claim 2, further comprising:

an urging member that urges the guided shaft away from the first abutment portion of the second link member to move the guided shaft toward the holding portion of the guide member.

5. The image forming apparatus according to claim 1, wherein the holding member comprises a guide that follows a track of movement of the holding member on both side surfaces of the holding member that intersect a first movement direction.

6. The image forming apparatus according to claim 1, wherein the holding member comprises a pressing member that presses the exposure device at the exposure position toward the image holding element.

7. The image forming apparatus according to claim 1, wherein the image holding element is mounted to and removed from the apparatus body through the opening portion of the apparatus body which is opened and closed by the open/close member.

* * * * *